United States Patent [19]

Evans

[11] Patent Number: 5,028,930

[45] Date of Patent: Jul. 2, 1991

[54] COUPLING MATRIX FOR A CIRCULAR ARRAY MICROWAVE ANTENNA

[75] Inventor: Gary E. Evans, Hanover, Md.

[73] Assignee: Westinghouse Electric Corp., Pittsburgh, Pa.

[21] Appl. No.: 504,706

[22] Filed: Apr. 4, 1990

Related U.S. Application Data

[63] Continuation of Ser. No. 290,389, Dec. 29, 1988, abandoned.

[51] Int. Cl.[5] ..... H01Q 3/22; H01Q 3/24; H01Q 3/26

[52] U.S. Cl. ..... 342/373; 342/374

[58] Field of Search ..... 342/368, 372, 373, 374, 342/403, 406, 427; 343/700 MS File

[56] References Cited

U.S. PATENT DOCUMENTS 3,839,720 10/1974 Reindel .
3,940,770 2/1976 Fassett et al. ..... 343/754
3,964,066 6/1976 Nemit .
3,997,900 12/1976 Chin et al. .
4,150,383 4/1979 Andersson et al. ..... 343/771
4,231,040 10/1980 Walker .
4,316,192 2/1982 Acoraci .
4,318,104 3/1982 Enein .
4,414,550 11/1983 Tresselt .
4,425,567 1/1984 Tresselt .
4,639,732 1/1987 Acoraci et al. .
4,692,768 9/1987 Becavin .

*Primary Examiner*—Theodore M. Blum
*Attorney, Agent, or Firm*—J. L. Brzuszek

[57] ABSTRACT

A coupling matrix for a circular array microwave antenna is described which permits the formation and phasing of multiple beams from a circular array. The present invention provides a beam forming and steering means for a circular array which utilizes at least one radio frequency signal as an input to a matrix of passive proximity couplers. These passive proximity couplers are configured in rows and are operable to form the radio frequency signal. These couplers are interconnected into distinguishable groups.

12 Claims, 7 Drawing Sheets

COUPLING MATRIX FOR A CIRCULAR ARRAY MICROWAVE ANTENNA

This application is a continuation, division, of application Ser. No. 07/290,389 filed Dec. 29, 1988, now abandoned.

BACKGROUND OF THE INVENTION

1. Field of the Invention

The present invention relates to microwave coupling networks, and more particularly to such networks used in the formation of multiple transmission beams from a circular radar or communications array.

2. Description of the Prior Art

It is well known in the prior art that phased arrays can be steered in angle by varying the phase of the drive on each element of the antenna array Such phasing is commonly performed with electronic phase-shifters in linear and planar arrays and with a combination of switching and phase-shifters in circular arrays. well-known method of steering a beam transmitted from an array of emitters uses a coupler network to control the phase of the signal sent to the emitters in step increments by switching an input signal among several inputs of the coupler network. The method is most applicable to planar or linear arrays rather than the circular arrays addressed here. It is also well known in the prior art to steer linear or planar arrays utilizing passive elements.

The Butler Matrix is also a well-known example of a coupler network in the prior art for achieving the effect of steering transmitted beams in planar and linear arrays. When applied to circular arrays, however, the Butler Matrix must be utilized with a multiplicity of variable phase and fixed phase shifters in combination with a power divider in order to achieve both phase and amplitude distributions. Typical Butler Matricies use 3 dB couplers for uniform illumination and one beamwidth steps. The Butler Matrix switching method for circular arrays is an extremely complex system requiring costly and potentially lossy phase shifters.

The Butler Matrix operated in conjunction with active phase shifters is a well-known method in the prior art to form and steer circular and cylindrical arrays. The U.S. Pat. No. 4,316,192, issued Feb. 16, 1982, to J. H. Acoraci entitled, "Beam Forming Network for Butler Matrix Fed Circular Array"; the U.S. Pat. No. 4,414,550, issued Nov. 8, 1983, to C. P. Tresselt entitled, "Low Profile Circular Array Antenna and Microstrip Elements Therefor"; the U.S. Pat. No. 4,425,567, issued Jan. 10, 1984, to C. P. Tresselt entitled, "Beam Forming Network for Circular Array Antennas"; and, U.S. Pat. No. 4,639,732, issued Jan. 27, 1987, to J. H. Acoraci et al. entitled, "Integral Monitor System for Circular Phased Array Antenna," all describe and claim the signal forming and steering technique.

Circular arrays are more difficult to steer than planar linear arrays, because both the phase and amplitude must be controlled to achieve steering. Neither phase nor amplitude varies linearly.

The problem to be solved therefore is the development of a direct method of forming multiple orthogonal beams from a standard circular or cylindrical array, wherein one or more beams may be formed simultaneously or switched around the circle or a sector of the circle of the array.

SUMMARY OF THE INVENTION

The present invention provides a beam forming and steering means for a circular array which utilizes at least one radio frequency signal as an input to a matrix of passive proximity couplers. These passive proximity couplers are configured in rows and are operable to form the radio frequency beam. These couplers are further interconnected into distinguishable groups. These couplers could be fabricated of coaxial cables, microstrip or waveguides. A circular array of radiating elements are interconnected to the groups of couplers. These radiating elements which can be waveguides, patch radiators or dipoles, for example, are operable to emit the formed signal received from the grouped couplers as a beam. Through the use of a particular type of microwave coupler, the proximity coupler, which has the characteristic that the coupled port is advanced in phase over the through-port, combined with a particular configuration of coupler interconnections, we are able to accomplish beam formation and steering by simply switching inputs. No additional phase-shifting or amplitude control devices are necessary. Finally, a switching means is used to switch the input signal between the grouped couplers. This switching between the couplers and therefore the radiating elements is used to steer the beams around the array. Alternatively; multiple beams may be formed in different directions simultaneously be connecting to multiple ports.

This invention also encompasses a method of beam steering and forming performed by the above apparatus. The use of a passive device for performing most of the functions previously performed by active components, such as for example phase shifters and attenuators, is a further improvement over the prior art. The apparatus of this invention is suited to switching of a circular or cylindrical array in a conformal application, such as in the fuselage of an airplane.

BRIEF DESCRIPTION OF THE DRAWINGS

For a better understanding of the invention reference may be had from the preferred embodiment exemplary of the invention shown in the accompanying drawings, in which.

DESCRIPTION OF THE PREFERRED EMBODIMENT

It is well known in the prior art to switch planar and linear phased radar arrays in angle by varying the phase of the drive signal on each radiating element.

Figure 1:
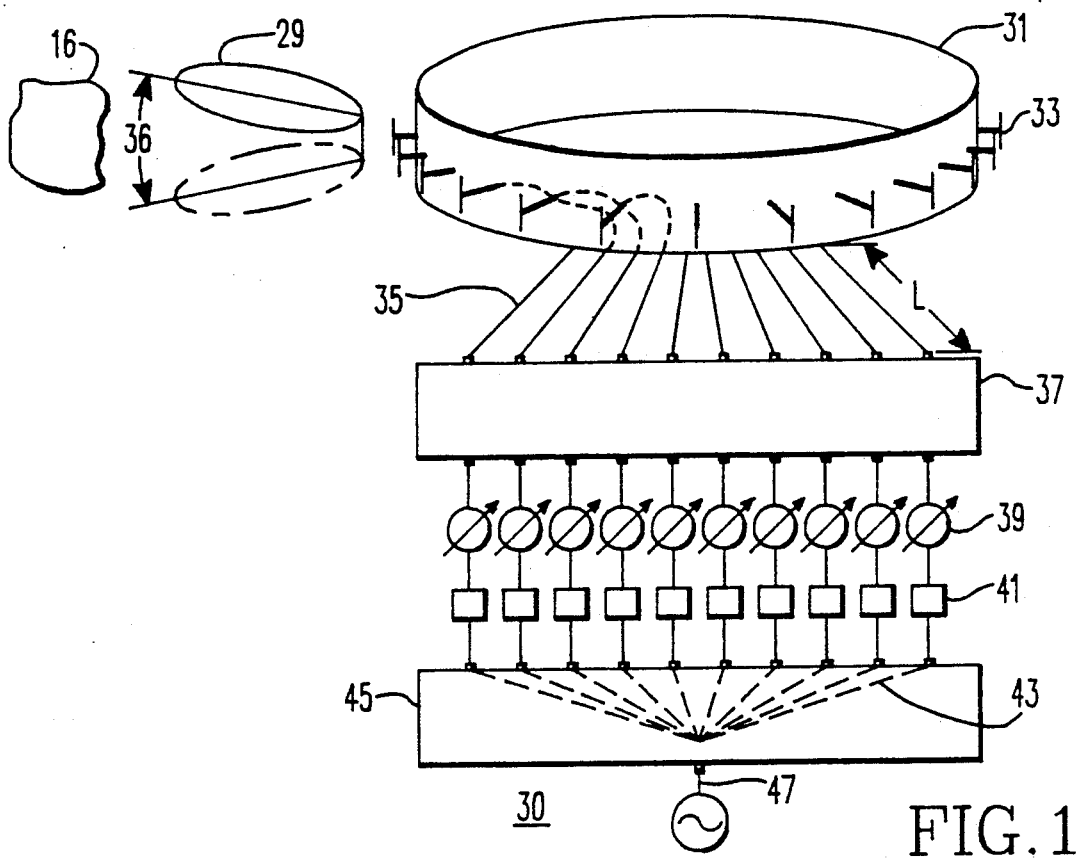
FIG. 1 PRIOR ART
FIG. 1 is a schematic representation of the prior art method of switching signals for circular or cylindrical antenna arrays.

A switching method for a linear emitting array is well known in the prior of FIG. 1. As an alternative to using a phase-shifter on each radiator. The switching method, utilizing a coupler matrix 37 is operable to steer in steps. The emitted signals are directed towards a target 16 through array elements 33 and steer in an angle 36 varying the phase of the drive signal on each element.

Phase change, in steps, is achieved by switching among the inputs to a matrix of couplers 37 by a mechanical or electrical switching means which receives its signal from the transmitting/receiver means.

The Butler Matrix is well known in the prior art, and it uses couplers for uniform illumination and one beamwidth steps. The coupler network receives input line signals; and after dividing through the network, these same signals 35 are emitted as radiated signals from individual radiating array elements 33.

The signals of the Butler Matrix are distributed functionally by a network of directional microwave power dividers 45 such as, for example, waveguides, microstrip elements or coaxial cable devices. The radiating array elements 33 may be, for example, horns, dipole antennas, patch or slot radiating devices. The target 16 towards which the signals are directed could also be an emitting source, such as another radar system.

Circular or cylindrical emitting arrays 30 are more difficult to steer, since both the phase and amplitude must vary for steering, but neither phase nor amplitude varies linearly. Cylindrical or circular arrays can be steered with a multiplicity of phase shifters, switches and couplers. Of the several existing methods, the prior art method which functions most like a matrix switching method is shown in FIG. 1. The array 30, in FIG. 1, has a Butler Matrix 37 which is used with active phase-shifters to steer the emitted beams 29 directed toward target 16. The cylindrical support 31 is studded with radiators such as the dipoles 33 illustrated in this embodiment. Transmission lines 35, all of equal line length, "L", interconnect at the dipoles 33 to the Butler Matrix 37. The settings of the variable phase-shifters 39 in each matrix input 35 thereby determines a steering "scan" angle 36. A power divider 45, comprising the lines 43 which are driven by the signal generator 47, drive first the fixed phase-shifters 41 and then the variable phase-shifters 39. The cylindrical steering method as shown in FIG. 1 for a circular cylindrical array 30 employs a complex system utilizing costly arrays of phase-shifters 41, 39. This method with its multiplicity of active elements such as fixed and variable phaseshifters 41, 39 produces a signal system of considerable expense and overall system weight.

Figure 2:
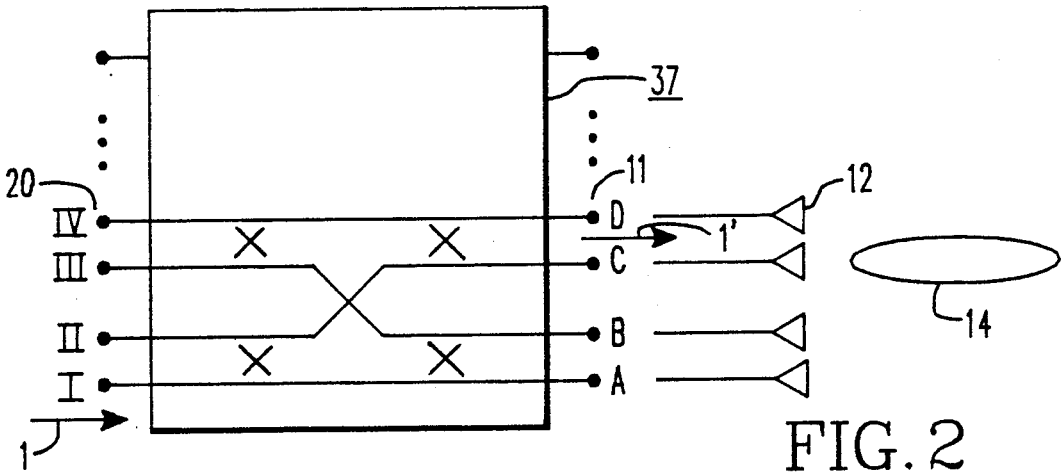
FIG. 2 PRIOR ART
FIG. 2 is a schematic representation of the prior art orthogonal beam forming matrix.

The Butler Matrix 37, as shown in the schematic representation of FIG. 2, for a 4×4 example, utilizes all 3 dB couplers in a specific configuration. A coupling matrix in its broadest functional sense receives an energy signal 1 through port I. This input signal 1 will be seen at all four output ports A, B, C and D, as output signal 1'. This concept of the orthogonal beam forming network is well-known in the prior art as a Butler Matrix, and it is well known that larger quantities of inputs and outputs may also be suitably configured. This coupling function may be physically realized in any of the following forms, i.e., coupled line segments, microstrip on substrate technology, waveguides or coaxial cable. The output ports 11 direct the output signal 1' through the radiating or emitting elements 12 as a steered output signal 14.

Figure 3:
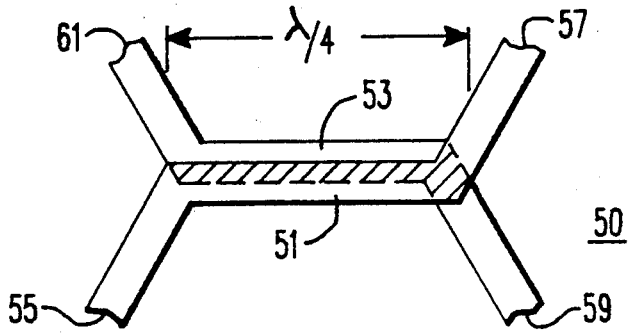
FIG. 3 PRIOR ART
FIG. 3 is a plan view of the prior art proximity coupler.

FIG. 3 is a plan view of a prior art proximity coupler 50. To radiate a plane wave radially from a circular array, it is necessary to excite a portion of the circular array with signals having phases that become more negative in the center of the signal and, for low sidelobes, having a larger amplitude in the center of the signal. The proximity coupler as shown in FIG. 3 has this capability of having 90° more negative phase in the stronger signal, through arm 57 than in the weaker signal coupled arm 61.

The proximity coupler 50, as shown in plan view of FIG. 3, comprises two stripline or other center conductive conductors 51, 53 which overlap. Where conductors 51, 53 overlap is an area of coupled conductors approximately a quarter wavelength in length (¼). The overlapping conductor 51 which is layered upon subordinate conductor 53 is signal-phased at input arm 55 at 0°, and this signal emerges at a negative 90° at the through arm 57, at midband. The underlying, subordinate conductor 53 has signal isolated arm 59 and carries the coupled signal, now phased at 0° at the weaker signal coupled arm 61. A matrix of couplers 50, conformed in a circular arrangement as shown in greater detail, unrolled for illustration in FIGS. 4 and 4A, respectively, provides the desired signal coupling and beam forming function by producing a stronger 90° negative phase in the stronger through arm 57 of the individual couplers 50. The concept of the proximity coupler 50 as shown in FIG. 3 is functionally not unlike the "magic tee". A radio frequency signal entering the coupler through input arm 55 is electromagnetically coupled to the stripline or other center conductor beneath the subordinating conductor, until the signal 53 exits at coupler output 61 and through arm 57 containing the stronger portion of the signal.

Figure 4:
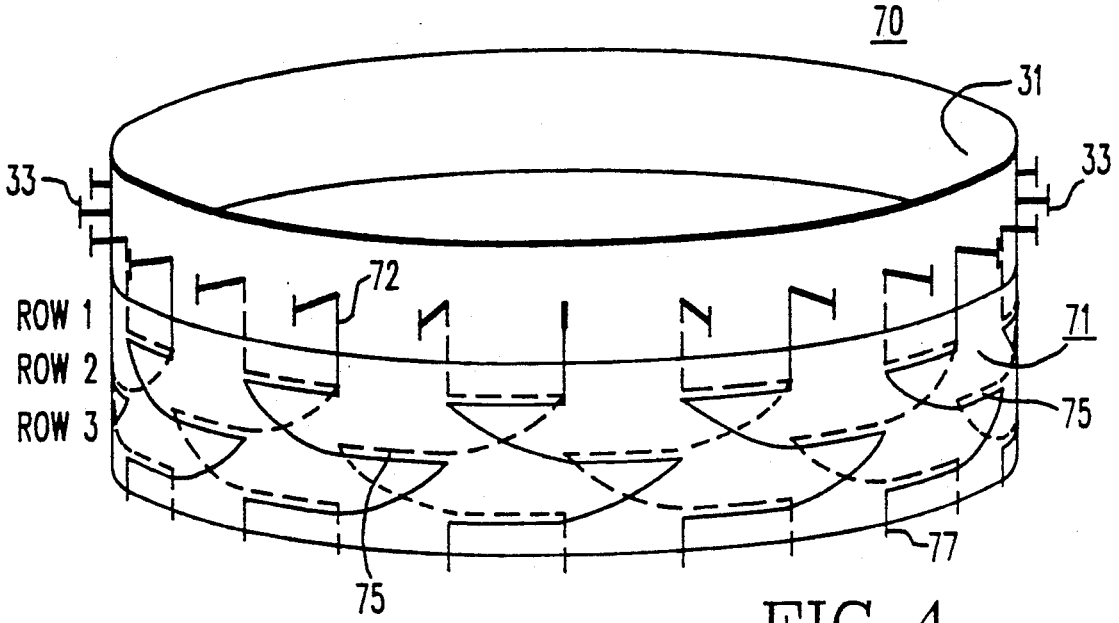
FIG. 4 is an isometric view of an example of the preferred embodiment for a beam forming network for a circular or cylindrical array.

FIG. 4 is an isometric view of an example of the preferred embodiment of a beam forming network 71 of rowed proximity couplers 75 for a circular or cylindrical array 70. As also shown in FIG. 4, the array 70 having the beam forming network 71 comprised of a multiplicity of row couplers 75 functions not unlike the prior art array using a Butler Matrix 37 as shown in FIG. 2. Radio frequency signal inputs 77 bring into the array 70, RF signals to be emitted from the dipoles 33 where these dipoles 33 are studded around the circumference of a cylindrical support structure 31. Feed lines 72 from the matrixed, columned couplers 75 interconnect the emitters 33 with the individual couplers 75. When driven by a switch the passive proximity couplers 75 interconnected as in FIG. 4A function effectively as assemblage or active phase shifters forming beams of emitted energy from the dipole radiators 33. However, they may also provide multiple beams simultaneously, which the phase shifters cannot do.

Figure 4A:
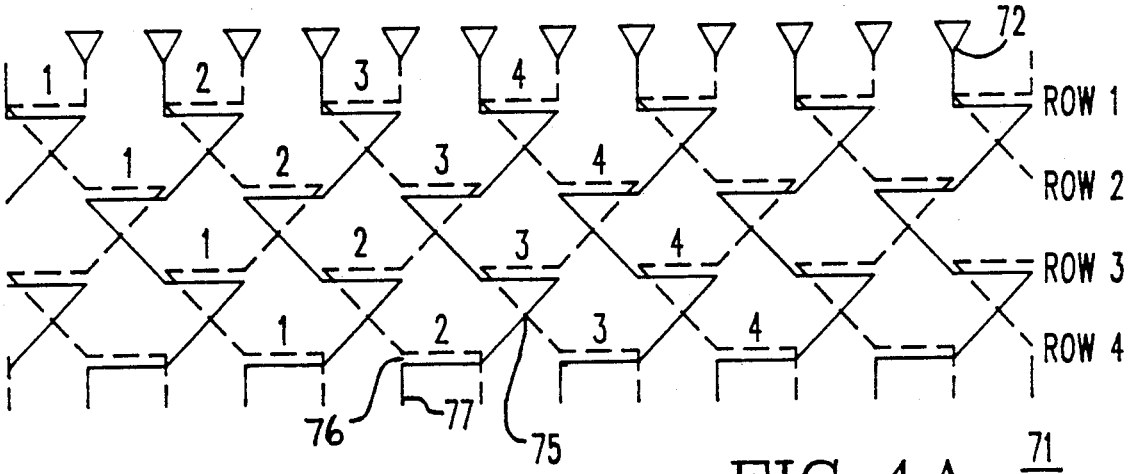
FIG. 4A is a schematic representation of one example of the preferred embodiment, the disclosed beam forming network.

FIG. 4A is a schematic representation of an example of the preferred embodiment, the disclosed beam forming network 71 in a cylindrical application as first shown in FIG. 4. The "unwrapped" network 71, now appearing as being planar has row 1 through row 4 of matrixed couplers 75 residing upon a cylinder support structure 31. The input 77 is divided in the region 76 between the two quarter wavelength segments of the electromagnetic couplers. The proximity couplers laterally upon the cylinder surface as necessary to provide an output for each array emitting element. Each signal received as an input by a proximity coupler 75 is seen to electromagnetically couple to 2N adjacent elements where, N is the number of rows of couplers 75. As shown in this example, FIG. 4A, one input signal for, four rows of couplers will drive four pair or eight emitting elements. Thus N, which is the number of rows, determines what fraction of the circumference of the cylindrical emitter array 70 is driven, by those N rows of proximity couplers 75. Each row of couplers will have one half as many couplers as emitting elements, for example, each row of an array having 32 emitting elements would comprise 16 couplers.

Also, as shown in FIG. 4A, at each coupler 75, the coupled voltage $V_c$, is $ke^{jo}$ times the input voltage $V_i$ and the through voltage $V_t$ is:

$$V_t=(1-k^2)^{\frac{1}{2}}e^{j\pi/2}\times v_i=\sqrt{1-k^2}e^{j\pi/2}\times v_i$$

where k, is the voltage coupling coefficient. Therefore, the bulk of the coupler power goes to the central overlapping coupled elements 76 of each proximity coupler 75. The outermost emitting elements of the active group of elements receive $K^n$ volts, therefore defining the amplitude taper of the signal. Also, k need not be the same voltage coupling coefficient in each row N. The k maybe unique for each row; for example, row 1 has a $k_1$, row 2 a $k_2$, $k_3$ ..etc.

As shown in FIG. 4A, an input radio frequency signal which enters the matrix through input individual lines 77 is switched around the network. It is by symmetry that the signal distribution will move around the cylindrical emitting array 70 correspondingly. As shown in FIG. 4, if the geometry of the emitting array 70 can be selected, i.e. the number of emitting elements 72, number of proximity couplers 75, the number of rows 71 of couplers 75 with a coupling coefficient k providing a suitable taper in amplitude and phase for each signal, then a steered, formed beam circular array 70 can be determined. As an example, for sixteen emitting elements formed into a cylinder which four are active, two rows of eight, or a total of of sixteen proximity couplers 75 will function for the correct diameter. Large emitting arrays comprising more proximity coupling elements and switches, therefore requiring a more gradual phase change for the emitted signals and therefore a more complex solution.

The array as shown in FIG. 4A, for example a thirty-two element array, would typically require one quadrant of eight elements per thirty-two to be active. Each row of proximity couplers 75 would comprise sixteen couplers 75 with correspondingly four rows each of said couplers 75. The disclosed beam forming network 70 of FIG. 4 would realistically produce an asymmetry of half an element space. This means that one proximity coupler element lies on the center of the matrix with four proximity coupler elements on one side and three proximity coupler elements on the other. However, this asymmetry can be ; avoided by changing the bottom row of proximity couplers into equal phase couplers, for example Wilkinson couplers, thereby producing an even symmetry of couplers as shown in FIG. 6C.

This bottom row is the only row for which symmetrical couplers are appropriate, since symmetrical halves of the active sector are driven from this location.

Figure 5:
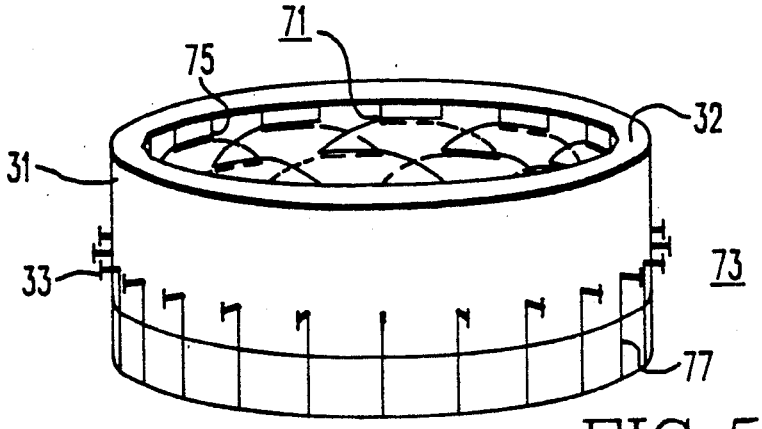
FIG. 5 is an isometric view of an alternative embodiment for a beam forming network, having reduced size and weight in a conformal application.

FIG. 5 is an isometric view of an alternative embodiment 73 of a beam forming network 71, having reduced size and weight, with application in a conformal environment comprised of a matrix. The beam forming network 71 is mounted concentrically within the transmitting cylinder 31, sharing a common ground plane 32 with the radiating elements 33. Input lines 77 bring in the signals from the network 71 which is comprised of a multiplicity of individual couplers 75. This configuration 73 is a more compact combination of coupler array 71 and cylindrical support 31 as shown in FIG. 4. This configuration or alternative embodiment 73 would be most applicable to conformal applications in, for example, an aircraft. Radiating elements 33 could be dipole antennas, patch radiators or slot antennas.

Because of the cylindrical emitting means 70 shown in FIG. 4, a cylindrical coupler arrangement is implied. However, this network 71 of individual couplers 75 could be flat or planar in configuration. This flat arrangement, including the radiators and the switch, if necessary, is shown in more detail shown in FIG. 6.

It is most appropriate in applications requiring the stacking of several circular arrays to form a cylindrical radiating surface.

Figure 6:
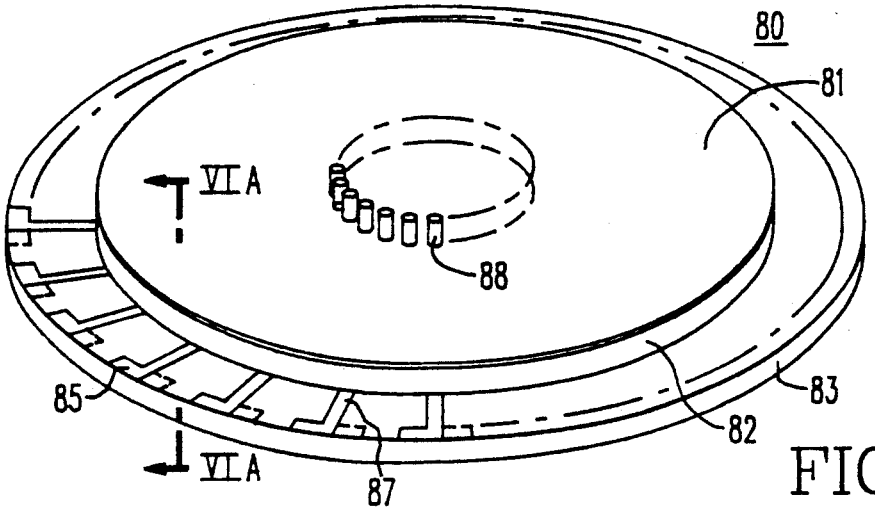
FIG. 6 is an isometric view of an alternative embodiment of a flat, stackable, circular array coupling matrix having a cross-section VIA—VIA.

This compact planar embodiment 80 operable for a multibeam antenna is described in the isometric view shown in FIG. 6. The compact planar embodiment 80, having cross-sectional view taken along line VIA—VIA is an isometric view of the circular coupling array 83 with coupling matrix 87. The ground plane 81 is supported by substrate 82. Layered beneath the substrate 82 is etched layer 83 which is slightly greater in circumference than substrate layer 82. Etched layer 83 has surrounding its circumference a multiplicity of radiating elements, here emitting dipoles 85 attached to proximity couplers 87. Input ports 88 are shown arranged in a circular configuration in the middle of the circular array 80.

Although described in terms of circuits etched on a dielectric substrate the method of beam switching is equally applicable to flat networks fabricated by other techniques.

Figure 6A:
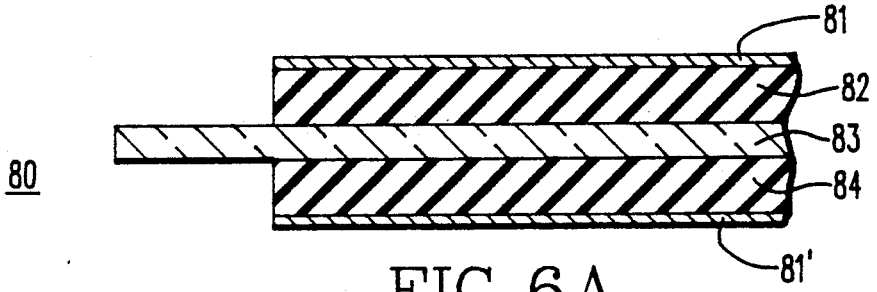
FIG. 6A is a cross-sectional view taken along line VIA—VIA of the alternative embodiment a circular planar array coupling matrix as shown in FIG. 6.

FIG. 6A is a cross-sectional view taken along line VIA—VIA of FIG. 6. Ground plane 81 is layered upon first support structure 82. Etched layer 83 rests upon second support substrate 84. A second ground plane 81' lies beneath second support substrate 84.

Figure 6B:
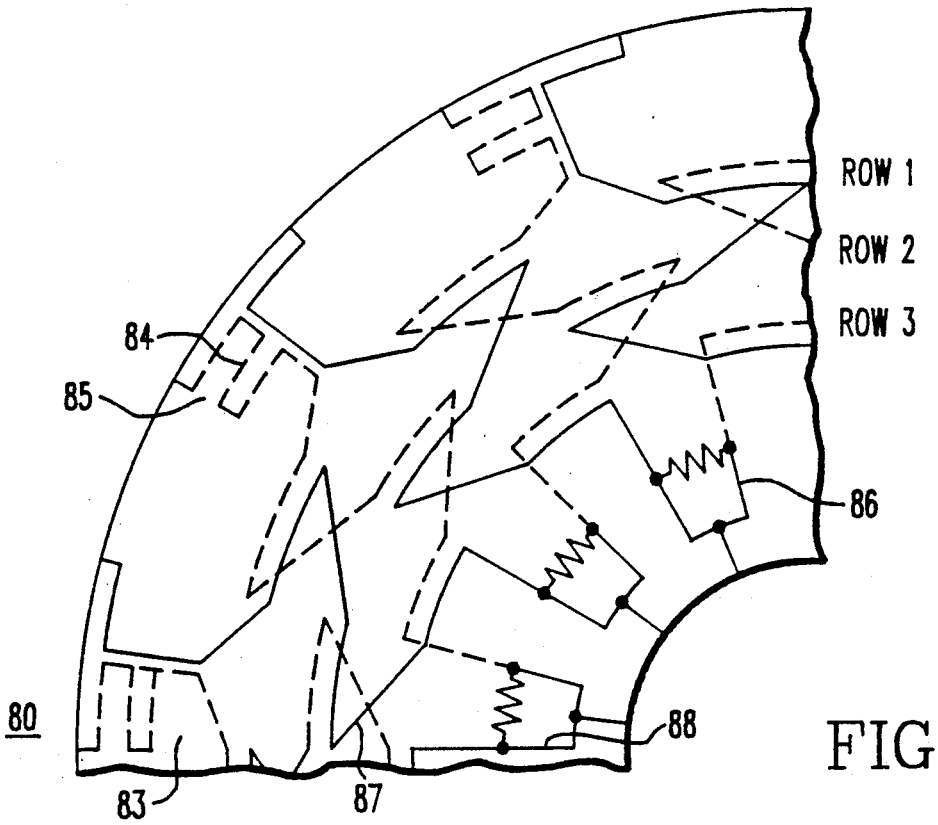
FIG. 6B is a schematic representation of the etched layer of the alternative embodiment as shown in FIGS. 6 and 6A.
Figure 6C:
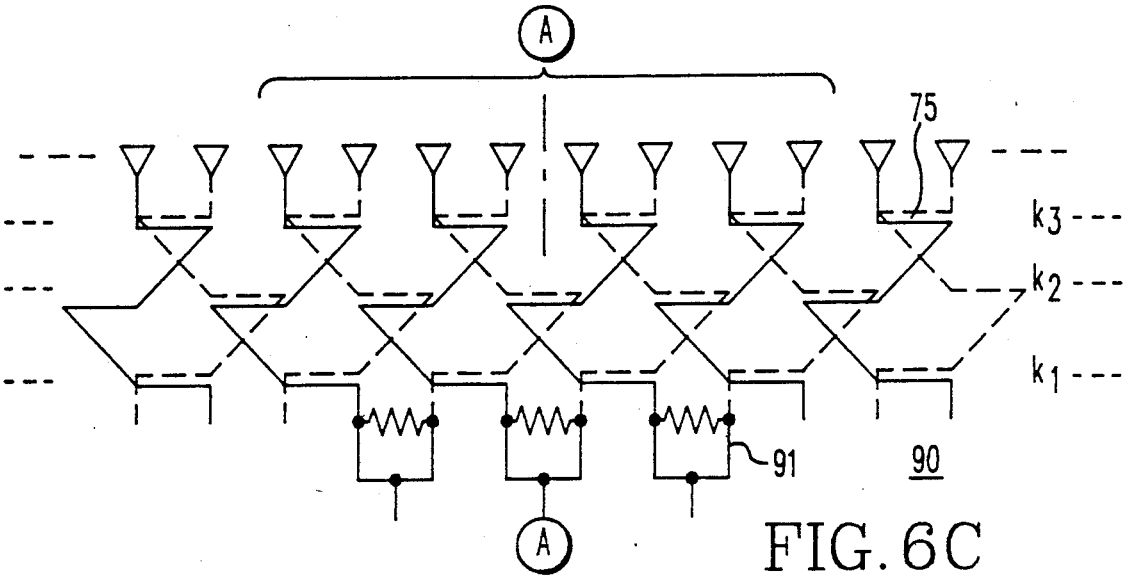
FIG. 6C is a schematic representation of etched layer of yet another alternative embodiment of a circular array coupling matrix as modified for symmetry.

FIG. 6B is a plan view of the etched layer 83 of the alternative planar circular embodiment 80 as shown in more detail in FIGS. 6 and 6A. Emitting elements here, dipoles 85 serve as the signal emitters located at the periphery of the etched layer 83. In this specific application, baluns 84 are utilized, and well known in the art to make the conversion from the unbalanced stripline of the couplers 87 to the balanced two conductor, dipole emitting elements 85. The matrix of couplers 87, in this example specific embodiment comprises three rows of couplers 87. Generally, the rows have one half the number of couplers for the number of total emitting elements. A signal splitter 86, one for each output port 88, serves to provide the symmetrical distribution for the transmitter/receiver portion, not shown here, of the radar system during transmission and reception.

FIG. 6C is a plan view of an alternative configuration 90 for the etched layer 71 for the cylindrical array 70 shown in FIG. 4A. FIG. 6C shows a modification of the last row of proximity couplers of the array 90 for symmetry purposes by using equal phase couplers or, for example, Wilkinson couplers. The array 90 comprises three rows of proximity couplers 75 with the final row of couplers 91 as a row of symmetrical couplers operational at 3 dB. Each of the three rows of proximity couplers 75 has its own coupling coefficient $k_1$, $k_2$ and $k_3$. Symmetry for the overall array is achieved about the midpoint A—A as shown in FIG. 6C. The design of FIG. 6C has been carefully experimentally developed to achieve signal symmetry. The utilization of voltage coupling coefficients having values of:

$$k_1=0.4$$

$$k_2=0.75$$

$$k_3=0.45$$

produce a planar front which best approximates a circle having the radius of approximately three wavelengths. To achieve this result, each proximity element in such a matrix configuration would be 0.59 wavelengths apart.

Figure 7:
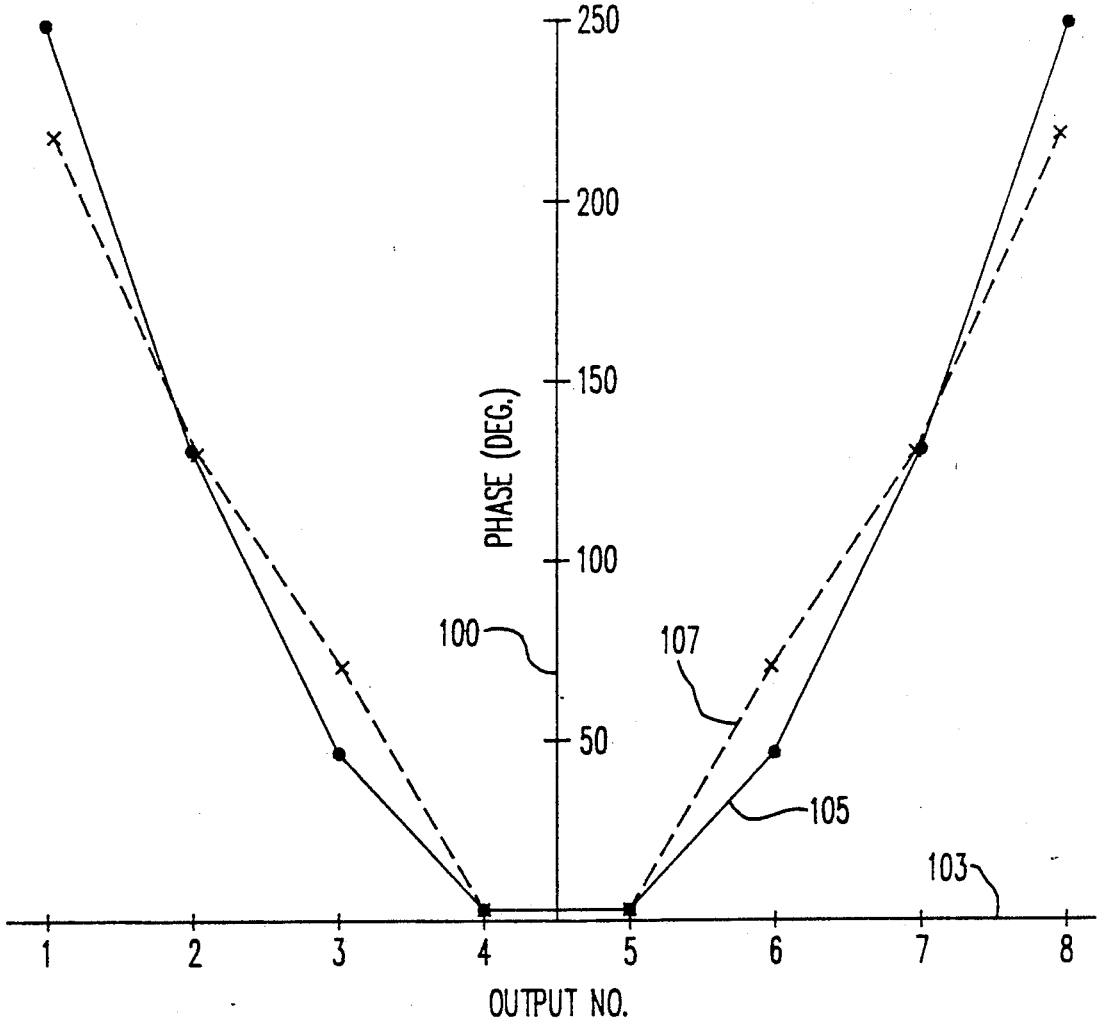
FIG. 7 is a graph of the results of a computer generated simulation showing computed phase approximation signal phase.

FIG. 7 is a graph of the results of a computer generated simulation showing the computed phase approximating the signal phase in degrees versus output numbers for the preferred embodiment of a coupling matrix for a circular array. The ordinates describe the change in phase in degrees, 100, from 50 through 200 degrees. This value is plotted against the abscissa 103, of the output of emitters from one through eight. The plot 107 which describes the change in number of computer network simulation output appears as a dotted parabolic function versus the theoretical plot shown as solid line parabolic function for an array of radiators located on 3 wavelength (h) radius circle.

Figure 8:
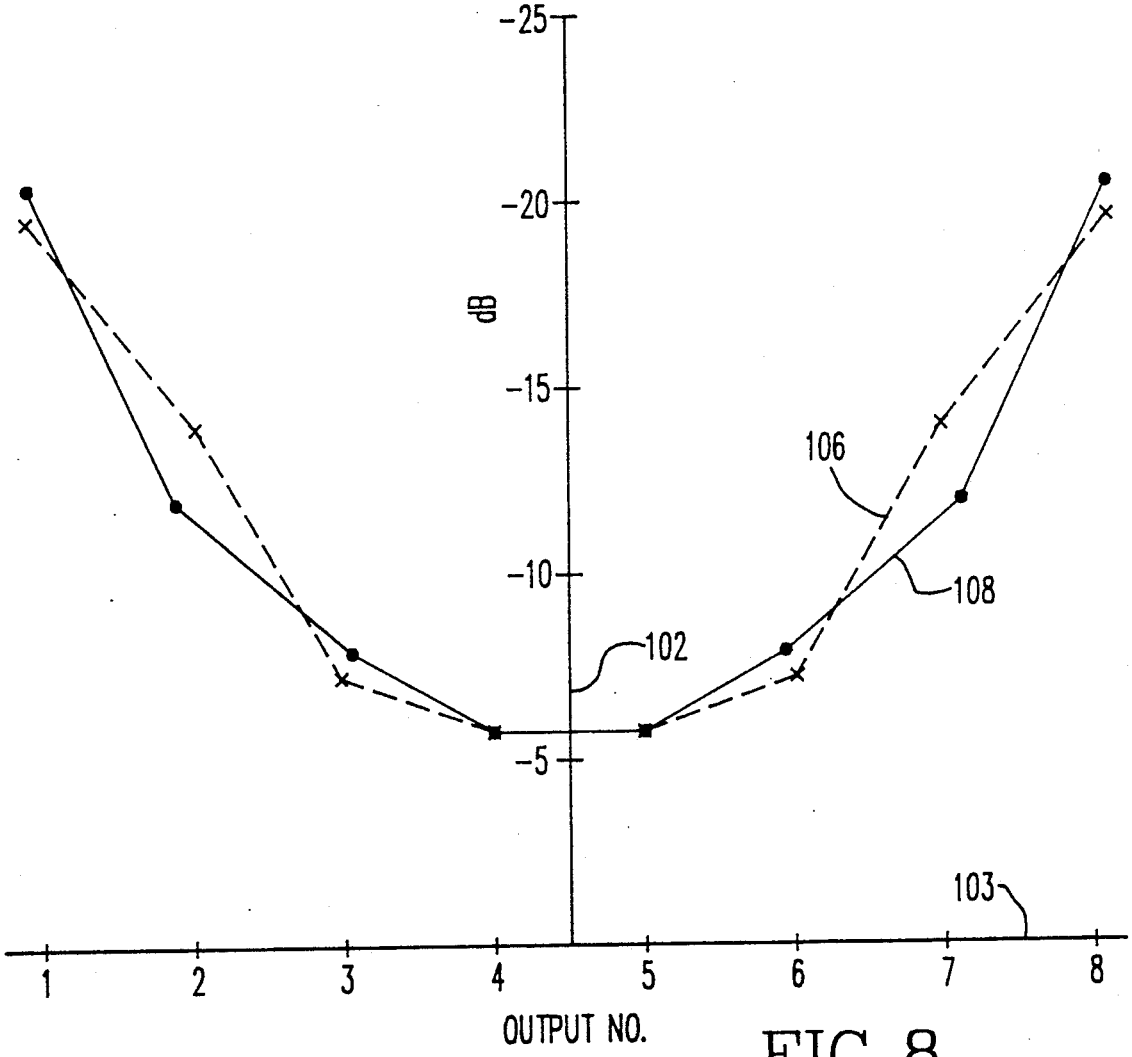
FIG. 8 is a graph of the results of a computer generated simulation of computed voltage amplitude for a cylindrical switching method comparing amplitude with a 35 dB Chebishev taper.

FIG. 8 is a graph of the results of a computer generated simulation of the computed voltage amplitude for a coupling matrix for a cylindrical switching method comparing the calculated results with a 35 dB Chebishev taper. The ordinate 102, in dB is plotted between negative 5 dB through negative 25 dB. The output number is computed for from one through eight emitters on the abscissa 103. The actual amplitude curve 106, for the computer generated simulation of the network is shown as a dotted, parabolic function. This projected parabolic curve 106 compares favorably with a standard 35 dB Chebishev plot 108, well known in the art.

Figure 9A:
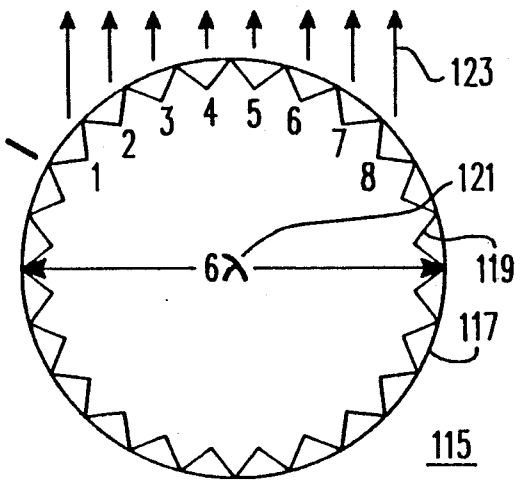
FIG. 9A is a top plan view of proposed cylindrical array having projection of taper on linear array.
Figure 9:
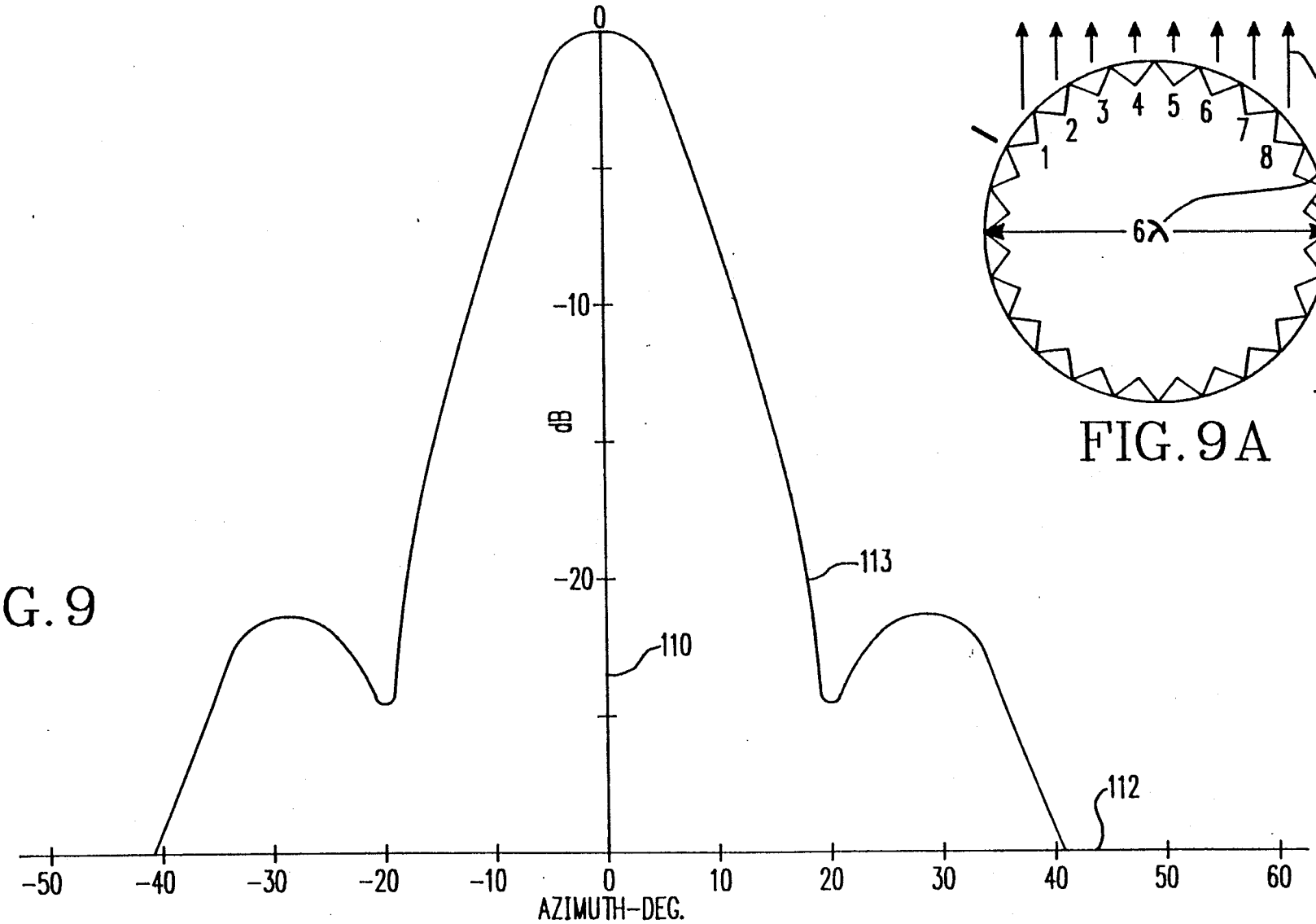
FIG. 9 is a graph of the results of a computer generated simulation of amplitude versus azimuth for a computed pattern of eight to 32 elements.

FIG. 9 is a graph of the results of a computer generated simulation of voltage amplitude versus azimuth in degrees for a computed pattern utilizing the preferred embodiment of a passive proximity coupling matrix for a circular or cylindrical array having eight out of thirty-two elements activated. A rough curve 119 of the of signal versus angle is shown in FIG. 9. The abscissa of this graph, the azimuth in degrees 112 is plotted against the 0 to 30 dB ordinate 110.

FIG. 9A is a top plan view of a proposed cylindrical array 115 having a diameter of approximately six (6) wavelengths. This cylindrical system 115 with circumference 117, around which are distributed emitting elements 119, is operable as an eight element array 123 to emit or receive signals utilizing the preferred embodiment of a passive proximity coupling matrix.

Figure 10:
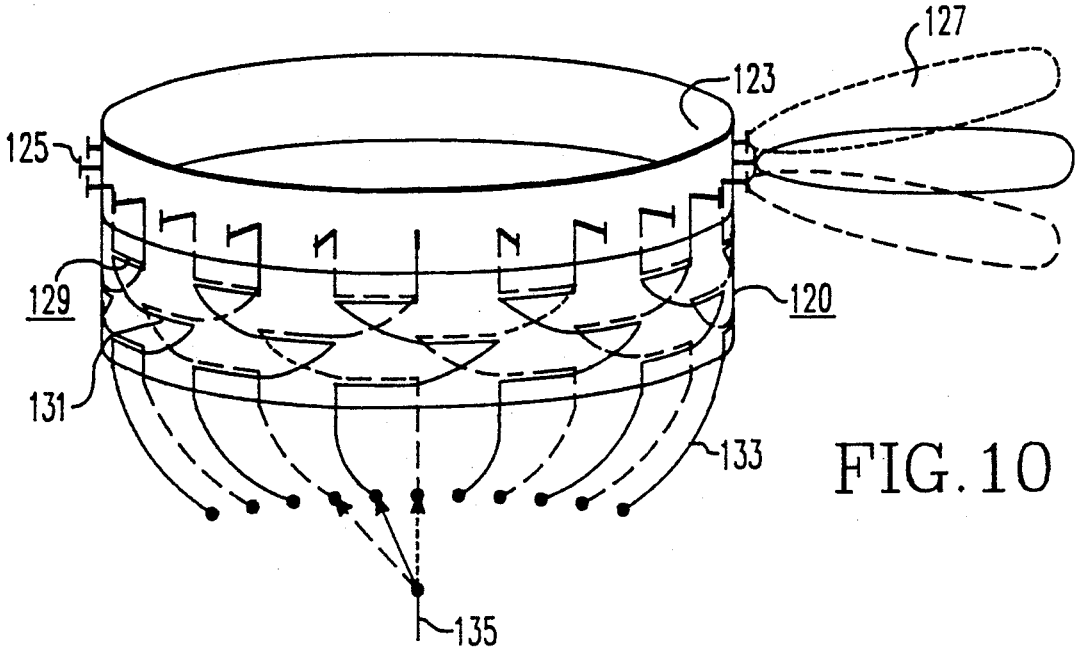
FIG. 10 is an isometric view of the preferred embodiment of a circular or cylindrical array with beam forming network having the connections for a switched beam.

FIG. 10 is an isometric view of the preferred embodiment a cylindrical array 120 having beam forming network 129 and switching interconnections 133. This configuration 120 would produce a wavefront comparable to a non-rotating beam antenna. The switching means 135 would electrically or mechanically switch between the various line inputs 133. The inputs 133 would drive the network 129 of proximity couplers 131, which is connected in a series of groups. In turn, these matrixed couplers 131 would shift the phase of signals 127 emitted from the radiators 125 studding the circumference of the cylinder 123, thereby steering the emitted signals.

Although shown with a single switch selecting one beam position at a time, it is evident that the input ports can be connected to a multiplicity of sources (or receivers) so as to simultaneously form a multiplicity of beams, up to and including one source (or receiver) for each input port (one per radiator).

Figure 11:
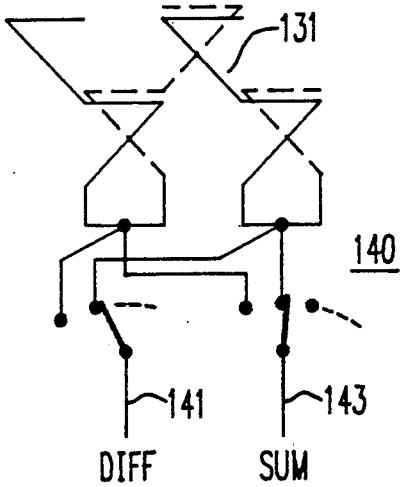
FIG. 11 is a schematic representation showing a switched beam configuration for monopulse applications.

FIG. 11 is a schematic representation of an alternative switching embodiment 140 operable to produce alternative beam shapes. In FIG. 11 the matrixed proximity couplers 131 are switched at both inputs between the difference 141 and the sum 143 of the signals in a monopulse application.

Figure 11A:
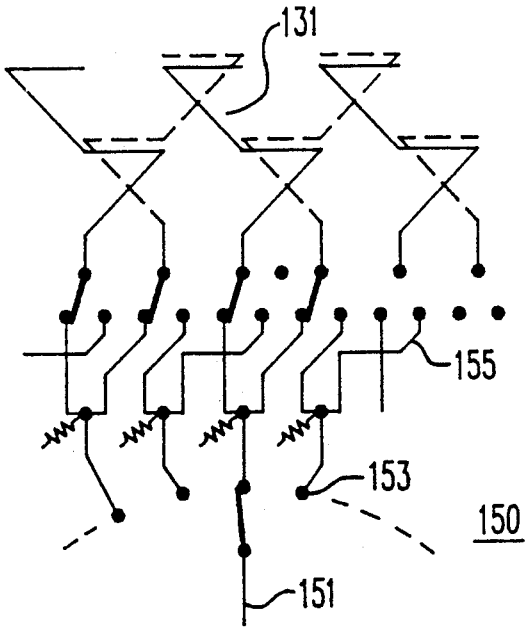
FIG. 11A is a schematic representation showing a switched beam configuration having intermediate beam positions.

FIG. 11A is a schematic representation of yet another alternative switching embodiment 150 which operable to produce intermediate beam positions. This alternative approach switches 151, via a switching means through various interconnect points 153 under a monopulse interconnection 155. Proximity couplers 131 are again used as passive phase shifters in lieu of active elements like variable or fixed phase shifters.

In summary, the beam steering and forming means of this invention forms a planar or linear phase front out of the circular or cylindrical surface of the array of emitting elements. The proximity couplers form the beams, while beam steering between quadrants or groups of couplers is achieved through the use of simple switches. Radio frequency signals in a phased array application can be formed and steered utilizing passive coupling elements and simple switches.

Numerous variations may be made in the above described combination and in different embodiments of this invention. They may be made without departing from the spirit thereof. Therefore, it is intended that all matter contained in the foregoing description and in the accompanying drawings shall be interpreted as illustrative and thus not in a limiting sense.

We claim:

1. A beam forming and steering means for an RF circular array antenna system which approximates a plane phase wave front for the beam, comprising:

a matrix arrangement of passive proximity couplers, said couplers being plurally operable to receive an input beam forming signal of predetermined amplitude and phase, said couplers being serially interconnected and positioned as to form one or more staggered rows, said couplers operable to receive said signal through a coupler in a staggered adjacent row below and further operable to shift the phase and increase the center amplitude of said signal, said couplers being further serially interconnected through alternate signal input ports being so adapted as to form radiating groups;

a circular array of radiating elements, said elements being connected to said groups of couplers with the terminating row of couplers connected to a plurality of said elements, said elements being operable to receive said phase shifted and increased center amplitude signal and to emit said phase shifted and increased center amplitude signal as a beam having a plane phase wave front for the circular array; and means for sequencing said phase shifted and increased center amplitude signal among said groups of couplers, said sequencing means being operable to form a plurality of said beams simultaneously or sequentially.

2. A beam forming and steering means for a circular array as in claim 1, wherein said sequencing means further comprises at least one switch, said switch being operable to produce intermediate steered beams.

3. A beam forming and steering means for a circular array as in claim 1, wherein said matrix of passive proximity couplers is formed on a cylinder.

4. A beam forming and steering means for a circular array as in claim 1, wherein said matrix of passive proximity couplers is formed on a plane with said circular array of elements being supported on a peripheral edge and radiating radially outward.

5. A beam forming and steering means for a circular array as in claim 1, wherein said proximity couplers further comprise coupled microstrip elements.

6. A beam forming and steering means for a circular array as in claim 1, wherein said proximity couplers further comprise coupled coaxial cables.

7. A beam forming and steering means for a circular array projecting a plane phase wave front, comprising:

a geometrically arranged matrix of passive proximity couplers, said couplers being plurally mounted upon a cylinder, said couplers being serially interconnected and positioned as to form rows, said couplers operable to receive a signal from a coupler in a staggered adjacent row below and further operable to form said signal shifted a quarter wavelength, said couplers being further serially interconnected through alternate signal input ports so as to form groups;

a circular array of radiating elements, said elements being mounted upon said cylinder, said elements connected to said groups of couplers with the terminating row of couplers connected to a plurality of said elements, said elements being driven operable to receive said formed signal and to emit said formed signal as a beam having a plane phase wave front for the circular array; and a means for sequencing said signal between said groups of couplers to form a plurality of said beams.

8. A beam forming and steering means for a circular array, comprising:

a matrix arrangement of passive proximity couplers, said couplers being plurally mounted upon a geometric plane in a circular configuration, said couplers being serially interconnected and positioned as to form rows, said couplers operable to receive a signal from a coupler in a staggered adjacent row below and further operable to form said signal shifted a quarter wavelength with a couple in a successively staggered row above, said couplers being further serially interconnected through alternate signal input ports so as to form groups;

a circular array of radiating elements, said elements being mounted upon said plane, said elements connected to said groups of couplers with the terminating row of couplers connected to a plurality of said elements, said elements being driven operable to receive said formed signal and to emit said formed signal as a known plane phase wave front for the circular array; and a means for sequencing said signal between said groups of couplers to form a plurality of said beams.

9. A beam forming and steering means for a circular array, comprising:

a cylinder, said cylinder having an interior and an exterior surface;

a matrix of passive proximity couplers, said couplers interconnected and positioned as to form rows upon said interior surface of said cylinder, said couplers operable to receive a signal, and said couplers further operable to form said signal, said couplers further interconnected as to form groups;

a circular array of radiating elements, said elements positioned upon said exterior surface of said cylinder, said elements connected to said groups of couplers, said elements operable to receive said formed signal and to emit said formed signal as a beam;

a common ground, said common ground conformed upon said cylinder between said matrix of passive proximity couplers and said circular array of radiating elements; and a means for switching said signal between said groups of couplers.

10. A method of beam forming and beam steering for an RF circular array antenna system which approximates a plane phase wave front for the beam, said method comprises:

providing a matrix arrangement of passive proximity couplers, said couplers being plurally serially interconnected and positioned to form staggered rows, said couplers operable to receive an input beam forming signal of predetermined amplitude and phase from a coupler in a staggered adjacent row below, said couplers further operable to phase shift and increase the center amplitude of said signal, said couplers being further serially interconnected through alternate signal inputs so as to form groups;

providing a circular array of radiating elements, said elements being connected to said groups of couplers with the terminating row of couplers connected to a plurality of said elements, said elements being operative to receive said phase shifted and increased center amplitude signal and to emit said phase shifted and center amplitude increased signal as a beam having a plane phase wave front for the circular array; and sequencing said signals between said groups of couplers to form a plurality of said beams simultaneously or sequentially.

11. An RF circular array antenna system which approximates a beam having a plane phase wave front, said system comprising:

a beam forming and steering means including a geometrically arranged matrix of passive proximity couplers, said matrix including a plurality of said proximity couplers each having an input arm port being operable to receive an input beam forming signal of predetermined amplitude and reference phase, a through arm port delivering as a coupled output a substantial portion of the input beam forming signal with a phase delay of a quarter wavelength with respect to the reference phase, a coupled arm port delivering an alternate signal output with a reference phase as received from an alternate signal input port at the remaining arm of the proximity coupler, said plurality of couplers being interconnected and positioned in a staggered pattern so as to form a plurality of rows with each one of said couplers in a succeeding row having its input arm port serially connected to the output of the through arm port of a coupler in the row next below and staggered to one side of it, and with the through arm port of each coupler in said row being serially connected with the input arm port of a coupler in the row next above and staggered to the same one side of it, said couplers being operable to receive said signal from the coupler in the row below and further operable to shift the phase and increase the center amplitude of said signal for each coupler transitioned, said couplers further interconnected so as to form a plurality of groups of interrelated couplers with each one of said couplers in a group being adapted to receive an input beam forming signal, respectively, for said remaining arm port being serially connected from the output of the coupled arm port of a coupler in the row next below and staggered to the other side of it, and with the coupled arm port of each coupler in said group serially connected with said remaining arm port of a coupler in the row next above and staggered to the same other side of it;

a circular array of radiating elements forming a geometric relationship with said plurality of rows of proximity couplers, said elements being connected to said groups of couplers with the terminating row of couplers connected to a plurality of said elements, successive elements of said row being connected, respectively, at the through arm port and the coupled arm port of each coupler in the row, so as to be driven operably by said phase shifted and increased center amplitude signal and to emit said phase shifted and increased center amplitude signal as a beam having a plane phase wave front without the need for external phase or amplitude control or modification for the circular array; and means for sequencing said phase shifted and increased center amplitude signal for said groups of couplers, said sequencing means operable to form a plurality of said beams simultaneously or sequentially.

12. A beam forming and steering means for a circular array as in claim 1, wherein said sequencing means further comprises receiver means including a plurality of receivers being operable to display intermediate steered beams.

* * * * *